US010244903B2

(12) United States Patent
Libman et al.

(10) Patent No.: US 10,244,903 B2
(45) Date of Patent: Apr. 2, 2019

(54) SCISSOR-STYLE TOILET BRUSH

(71) Applicant: The Libman Company, Arcola, IL (US)

(72) Inventors: Andrew D. Libman, Champaign, IL (US); Aaron Libman, Champaign, IL (US); Vincent H. Bowman, Highland Park, IL (US); Sam K. LaBanco, Northbrook, IL (US); William Andrew Mouratis, Chicago, IL (US); Christian J. Kulujian, Chicago, IL (US)

(73) Assignee: The Libman Company, Arcola, IL (US)

( * ) Notice: Subject to any disclaimer, the term of this patent is extended or adjusted under 35 U.S.C. 154(b) by 117 days.

(21) Appl. No.: 15/449,288

(22) Filed: Mar. 3, 2017

(65) Prior Publication Data

US 2017/0251891 A1 Sep. 7, 2017

Related U.S. Application Data

(60) Provisional application No. 62/303,786, filed on Mar. 4, 2016.

(51) Int. Cl.
*A47K 11/10* (2006.01)
*A46B 9/00* (2006.01)
(Continued)

(52) U.S. Cl.
CPC ..... *A47K 11/10* (2013.01); *A46B 5/0095* (2013.01); *A46B 9/005* (2013.01); *B25G 1/102* (2013.01);
(Continued)

(58) Field of Classification Search
CPC ..... A47K 7/08; A47K 11/10; A46B 5/0095; A46B 7/04; A46B 9/005; A46B 17/02;
(Continued)

(56) References Cited

U.S. PATENT DOCUMENTS 3,380 A 12/1843 Boardman
170,519 A * 11/1875 Brown ..... 15/150
(Continued)

FOREIGN PATENT DOCUMENTS

CN 3598949 1/2007
FR 346327 A 1/1905
(Continued)

OTHER PUBLICATIONS

Dewalt Max Fit Screwdriving Set, oldest review Apr. 26, 2014, http://www.homedepot.com/p/DEWALT-Max-Fit-Screwdriving-Set-30-Piece-DWA2SLS . . . site visited Mar. 19, 2017.
(Continued)

*Primary Examiner* — Mark Spisich
(74) *Attorney, Agent, or Firm* — Banner & Witcoff, Ltd.

(57) ABSTRACT

A device for cleaning, comprising two elongated members affixed to each other by a pivoting point and capable of switching between an open and closed position. When in a closed position, shaped jaws at the ends of the members may grasp a cleaning implement in a fixed, non-rotating position, allowing a user to scrub a surface with the device while holding the handles at the opposite end of the members. When cleaning has concluded, the jaws may be opened to release and dispense with the cleaning implement.

19 Claims, 8 Drawing Sheets

(51) Int. Cl.

| | |
|---|---|
| ***B25G 1/10*** | (2006.01) |
| ***A46B 5/00*** | (2006.01) |
| *A47L 13/16* | (2006.01) |
| *A47L 13/46* | (2006.01) |

(52) U.S. Cl.
CPC ..... *A46B 2200/304* (2013.01); *A47L 13/16* (2013.01); *A47L 13/46* (2013.01)

(58) Field of Classification Search
CPC . A46B 2200/304; A47L 13/022; A47L 13/04; A47L 13/06; A47L 13/07; A47L 13/10; A47L 13/16; A47L 13/42; A47L 13/46; Y10S 294/902; B25B 7/08; B25B 9/02; B25G 3/00; B25G 3/12; B25G 3/20; B25G 3/22; B25G 3/24; B25G 3/38
USPC ... 15/150, 176.1, 176.6, 145, 177, 178, 146, 15/202, 209.1, 210.1, 229.13, 229.11, 15/244.1; 294/118
See application file for complete search history.

(56) References Cited

U.S. PATENT DOCUMENTS 339,652 A 4/1886 Horton
464,778 A * 12/1891 Quinn ..... 15/150
1,409,059 A 3/1922 Miller
1,438,794 A 12/1922 Tudor
1,524,008 A 1/1925 Samuel
1,538,279 A 5/1925 Berger
1,577,944 A 3/1926 Bennington
1,600,309 A * 9/1926 Blumenthal ..... A61B 17/2812 15/150
1,684,880 A 9/1928 Norton
1,718,909 A * 6/1929 Lange ..... A47L 13/022 15/229.13
1,807,239 A 5/1931 Guentzler
1,826,234 A * 10/1931 Acheson ..... A46B 3/10 15/194
1,897,365 A 2/1933 Duey
2,030,911 A 2/1936 Borden
2,033,263 A 3/1936 Tone
2,049,324 A 7/1936 Schneider
2,134,738 A 11/1938 Scheel
2,150,178 A 3/1939 Maywald
2,173,462 A 9/1939 Wagner
D122,815 S 10/1940 Crosby
2,221,128 A 11/1940 Bates
2,320,611 A 6/1943 Kandle
2,320,967 A 6/1943 Dunkelberger
2,398,408 A 4/1946 Buell
2,402,577 A 6/1946 Rodgers
2,438,152 A 3/1948 Semple
2,493,835 A 1/1950 Schimel
2,531,304 A * 11/1950 Seewald ..... A47L 13/46 15/143.1
2,648,085 A 8/1953 Rodgers
2,698,504 A 1/1955 Lotz
2,730,439 A 1/1956 Houchins
2,752,625 A 7/1956 Ponsell
2,771,722 A 11/1956 Field
2,786,223 A 3/1957 Ziskind
2,820,234 A 1/1958 Rigney
2,945,750 A 7/1960 Gareis
3,023,550 A 3/1962 Kristofik
3,067,450 A 12/1962 Happy
3,075,222 A 1/1963 Miller
3,100,311 A 8/1963 Tutino
3,161,085 A * 12/1964 Pratt ..... H01H 85/0208 294/118
3,333,292 A 8/1967 Chase et al.
3,413,673 A 12/1968 Gewirz
3,529,945 A 9/1970 Charvat
3,737,939 A 6/1973 Jones, Sr.
3,875,609 A 4/1975 Wells
3,949,137 A 4/1976 Akrongold et al.
4,007,524 A * 2/1977 Hannes ..... B21K 5/00 30/266
4,031,673 A 6/1977 Hagelberg
4,090,808 A 5/1978 Nannen
4,186,451 A 2/1980 Ruo
4,448,590 A 5/1984 Wray et al.
4,457,038 A 7/1984 Hammond
4,546,514 A 10/1985 Tutino
D283,375 S 4/1986 Rothrock
4,610,111 A 9/1986 Cox
4,663,796 A 5/1987 Helling et al.
4,714,389 A 12/1987 Johne
5,084,931 A * 2/1992 Kuhlcke ..... A46B 7/04 15/150
5,311,634 A 5/1994 Andros
5,399,116 A 3/1995 Ellis et al.
5,488,748 A 2/1996 Koch
D373,251 S 9/1996 Young
5,584,754 A 12/1996 Hash et al.
5,592,713 A 1/1997 Rones
5,630,243 A 5/1997 Federico et al.
5,673,955 A * 10/1997 Neubauer ..... A47J 45/10 294/118
D392,104 S 3/1998 Berti
5,779,404 A 7/1998 Jore
5,842,810 A 12/1998 Morad
5,865,077 A 2/1999 Moffitt, Jr. et al.
6,044,515 A 4/2000 Zygmont
D428,027 S 7/2000 Kouvelis
6,094,771 A 8/2000 Egolf et al.
D448,932 S 10/2001 Harada
6,295,688 B1 10/2001 Sayles et al.
6,336,241 B1 1/2002 Wilson
6,463,620 B2 10/2002 Busha
6,485,212 B1 11/2002 Bomgaars et al.
6,491,576 B1 12/2002 Vogel-Zaugg
D468,112 S 1/2003 Libman et al.
6,507,972 B2 1/2003 Hart
6,511,268 B1 1/2003 Vasudeva et al.
6,611,986 B1 9/2003 Seals
D483,916 S 12/2003 Crosswaite
6,709,185 B2 3/2004 Lefevre
D490,983 S 6/2004 Tini
6,745,427 B1 6/2004 Trenz et al.
D501,728 S 2/2005 Conway et al.
D502,002 S 2/2005 Conway et al.
D502,324 S 3/2005 Conway et al.
D506,128 S 6/2005 Foi
D509,033 S 8/2005 Dotterman et al.
D516,895 S 3/2006 Minkler et al.
7,032,270 B2 4/2006 Vitantonio et al.
D520,852 S 5/2006 Minkler et al.
7,059,008 B2 6/2006 Morgan et al.
7,065,825 B2 6/2006 Minkler et al.
7,065,838 B2 6/2006 Mitchell et al.
D524,058 S 7/2006 Tapp
7,127,768 B2 10/2006 Blum et al.
D532,945 S 11/2006 Charmoille et al.
7,146,676 B2 12/2006 Kubes et al.
7,159,265 B2 1/2007 Soller et al.
7,213,706 B2 5/2007 Belser et al.
D544,775 S 6/2007 Cybulski et al.
D544,776 S 6/2007 Cybulski et al.
D552,444 S 10/2007 Cybulski et al.
D552,445 S 10/2007 Cybulski et al.
D552,446 S 10/2007 Cybulski et al.
D552,816 S 10/2007 Cybulski et al.
7,275,276 B2 10/2007 Jaszenovics et al.
7,284,294 B2 10/2007 Kozakow
7,287,295 B2 10/2007 Treacy et al.
D556,537 S 12/2007 Cybulski et al.
7,316,046 B2 1/2008 Michaels et al.
7,343,638 B2 3/2008 Mitchell et al.
7,386,910 B2 6/2008 Minkler et al.
7,386,913 B2 6/2008 Jackson
7,393,348 B2 * 7/2008 Dworschak ..... A61B 17/28 606/1

(56) References Cited

U.S. PATENT DOCUMENTS

| | | | | |
|---|---|---|---|---|
| D575,518 | S | 8/2008 | Libman et al. | |
| D575,525 | S | 8/2008 | Libman et al. | |
| D575,528 | S | 8/2008 | Libman et al. | |
| 7,424,764 | B2 | 9/2008 | Trenz et al. | |
| D579,211 | S | 10/2008 | Libman et al. | |
| D588,365 | S | 3/2009 | Conway et al. | |
| D591,020 | S | 4/2009 | Dotterman et al. | |
| 7,581,276 | B2 | 9/2009 | Endo et al. | |
| 7,584,519 | B2 | 9/2009 | Ouellette et al. | |
| 7,603,739 | B2 | 10/2009 | Minkler et al. | |
| 7,650,663 | B2 | 1/2010 | Michaels et al. | |
| D609,871 | S | 2/2010 | Zach et al. | |
| D614,373 | S | 4/2010 | Zach et al. | |
| 7,743,451 | B2 | 6/2010 | Kim | |
| D623,417 | S | 9/2010 | Buck et al. | |
| 7,811,022 | B2 | 10/2010 | Bobrosky et al. | |
| 7,827,648 | B2 | 11/2010 | Soller et al. | |
| 7,841,927 | B2 | 11/2010 | Krause et al. | |
| D632,090 | S | 2/2011 | Cobabe et al. | |
| D632,490 | S | 2/2011 | Cobabe et al. | |
| D632,491 | S | 2/2011 | Lowe et al. | |
| 7,900,287 | B2 | 3/2011 | Wildauer et al. | |
| 7,904,987 | B2 | 3/2011 | Bayon et al. | |
| 7,958,590 | B2 | 6/2011 | Trefethren et al. | |
| 8,015,653 | B2 | 9/2011 | Bargiel et al. | |
| 8,151,400 | B2 * | 4/2012 | McCoy | A47K 7/08 15/150 |
| 8,286,295 | B2 | 10/2012 | Minkler et al. | |
| D696,828 | S | 12/2013 | Ashe et al. | |
| 8,628,385 | B2 | 1/2014 | Wu et al. | |
| D699,038 | S | 2/2014 | Ono | |
| D699,039 | S | 2/2014 | Ono | |
| D699,040 | S | 2/2014 | Ono | |
| 8,726,444 | B2 | 5/2014 | Gaines et al. | |
| D709,260 | S | 7/2014 | Molinet et al. | |
| 8,763,192 | B2 | 7/2014 | Uchiyama et al. | |
| 9,021,649 | B2 | 5/2015 | Minkler et al. | |
| D730,711 | S | 6/2015 | Chaffee et al. | |
| D737,011 | S | 8/2015 | Cho | |
| 9,408,522 | B2 | 8/2016 | Wang et al. | |
| 9,655,482 | B2 | 5/2017 | Michelson et al. | |
| 2002/0007527 | A1 | 1/2002 | Hart | |
| 2002/0132573 | A1 | 9/2002 | Rich et al. | |
| 2003/0070246 | A1 | 4/2003 | Cavalheiro | |
| 2004/0010877 | A1 | 1/2004 | Jackson | |
| 2004/0019996 | A1 | 2/2004 | Singer | |
| 2004/0093678 | A1 | 5/2004 | Hart et al. | |
| 2004/0177863 | A1 | 9/2004 | McKay | |
| 2004/0219869 | A1 | 11/2004 | MacKay | |
| 2004/0221410 | A1 | 11/2004 | Padula | |
| 2004/0223803 | A1 | 11/2004 | Fahy et al. | |
| 2004/0244130 | A1 | 12/2004 | Kim | |
| 2005/0055790 | A1 | 3/2005 | Brewer | |
| 2005/0138748 | A1 | 6/2005 | Cisneros | |
| 2005/0227600 | A1 | 10/2005 | Fisher | |
| 2006/0010625 | A1 | 1/2006 | Tapper et al. | |
| 2006/0168750 | A1 | 8/2006 | Dotterman et al. | |
| 2006/0174914 | A1 | 8/2006 | Murphy | |
| 2006/0225237 | A1 | 10/2006 | Gartland | |
| 2007/0079460 | A1 | 4/2007 | Tapp et al. | |
| 2007/0186365 | A1 | 8/2007 | Armaly | |
| 2007/0245508 | A1 | 10/2007 | Gartland | |
| 2008/0171501 | A1 | 7/2008 | Woods et al. | |
| 2008/0250590 | A1 | 10/2008 | Trefethren et al. | |
| 2008/0263797 | A1 | 10/2008 | Berger et al. | |
| 2009/0098812 | A1 | 4/2009 | Boeck et al. | |
| 2011/0225755 | A1 | 9/2011 | Carlson et al. | |
| 2012/0233800 | A1 | 9/2012 | Smets et al. | |
| 2012/0246854 | A1 | 10/2012 | Uchiyama et al. | |
| 2013/0071171 | A1 | 3/2013 | Stewart | |
| 2014/0013527 | A1 | 1/2014 | Molinet et al. | |
| 2014/0130827 | A1 | 5/2014 | Dotterman et al. | |
| 2014/0157535 | A1 | 6/2014 | Minkler et al. | |
| 2014/0182073 | A1 | 7/2014 | Mitchell | |
| 2014/0251844 | A1 | 9/2014 | Michelson et al. | |
| 2015/0157178 | A1 | 6/2015 | Burns | |
| 2015/0158149 | A1 | 6/2015 | Vela et al. | |
| 2016/0158919 | A1 | 6/2016 | Hanni et al. | |
| 2016/0184974 | A1 | 6/2016 | Srihari et al. | |

FOREIGN PATENT DOCUMENTS

| | | | | |
|---|---|---|---|---|
| GB | 2107973 | | * | 5/1983 |
| GB | 2099062 | | | 2/2001 |
| GB | 2362565 | A | | 11/2001 |
| JP | 2000-308600 | A | | 11/2000 |
| JP | 2005-81112 | | * | 3/2005 |
| JP | D1237274 | | | 4/2005 |
| JP | 2005-230498 | | * | 9/2005 |
| KR | 300471614.0000 | | | 12/2007 |
| WO | 01/15587 | A1 | | 3/2001 |

OTHER PUBLICATIONS

Prop cleaning—dremel cup brush? 1 SailboatOwners.com Forum date Dec. 13, 2008, [site visited Mar. 19, 2017 3:22:35 PM], https://forums.sailboatowners.com/index.php?threads/prop-cleaning-dremel-cup-brush.1 03909/.

Amazon.com: Forney 60183 Mounted Flap Wheel, review 2013, <https://www.amazon.com/Forney-60183-Mounted-3-Inch-120>-Grit/dp/B003X3UB1Y/ref- . . . site visited Oct. 5, 2017.

Amazon.com: Speedy Foam Buffing Pad F/Drills, website 2017, https://www.amazon.com/speedy-foam-buffing-pad-drills/dp/bOOI 4432bu site visited Oct. 4, 2017.

Scotch-Brite Flap Wheel, website 2017, <https://www.grainger.com/product/SCOTCH-BRITE-3-Mounted-Flap-Wheel-With>-4ZR48 . . . site visited Oct. 9, 2017.

60Pcs Polishing Wheel Buffing Pad Brushes, website 2017, https://www.solidrop.net/product/60pcs-polishing-wheel-buffing-pad-brushes-set-dremel-r. . . site visited Oct. 4, 2017.

* cited by examiner

SCISSOR-STYLE TOILET BRUSH

RELATED APPLICATIONS

The present application is a non-provisional application of U.S. Provisional Application No. 62/303,786, filed Mar. 4, 2016. The content of this application is incorporated herein by reference in its entirety for all purposes.

FIELD

Aspects described herein generally relate to a hand tool for hygienic cleaning of surfaces. More specifically, aspects provide for a hinged tool capable of firmly grasping a cleaning attachment, transferring force from a user along a handle to scrub a surface with the cleaning attachment, and releasing the cleaning attachment into a waste receptacle without the user needing to touch or manipulate the cleaning attachment.

BACKGROUND

Traditional toilet brushes consist of a long handle terminating in a head of permanent bristles, used to scrub the inner surface of a toilet bowl. This construction leads to several problems: the bristles may become contaminated with bacteria or detritus over the course of repeated cleanings, the bristles cannot be easily cleaned without exposing the user to that contamination, and the bristles cannot be replaced, requiring replacement of the entire brush.

BRIEF SUMMARY

The following presents a simplified summary of various aspects described herein. This summary is not an extensive overview, and is not intended to identify key or critical elements or to delineate the scope of the claims. The following summary merely presents some concepts in a simplified form as an introductory prelude to the more detailed description provided below.

Aspects described herein are directed to a toilet brush which may be made from two elongated members connected by a pivot point. The elongated members may rotate about the pivot point with respect to each other when a user manipulates handles which may be on one side of the pivot point. The elongated members may terminate in a pair of jaws on the other side of the pivot point, which may grasp a cleaning implement in a fixed position when the handles are manipulated into a closed position, and which may release the cleaning implement when the handles are manipulated into an open position.

The jaws may be configured to grasp a cleaning implement with a predefined shape, and may, when in a closed position, form a cavity configured to fit the predefined shape with a minimum or absence of empty room for the cleaning implement to move within. The cleaning implement may have a head with a polygonal cross section, and the cavity may have a similarly shaped cross section into which the head of the cleaning attachment snugly fits, and within which the head may not rotate due to the sides of the head being in contact with the walls of the cavity. The cavity may furthermore have a depth corresponding to a head of the cleaning attachment, and an aperture out of the cavity which is configured for a neck of the cleaning attachment but insufficiently large for the head of the cleaning attachment to pass through. The cavity may thus both prevent movement of the cleaning implement out of and away from the jaws' grasp, as well as prevent rotation of the cleaning implement within the jaws, around the axis of the members' elongation. A user may thus firmly grasp a cleaning implement within the device by using the handles to open the jaws, and then closing the handles to cause the jaws to close around the cleaning implement.

Many different shapes for the elongated members are possible, and may be configured to improve the usability of the brush by affecting: its ability to be gripped by a user, its capacity to grasp a cleaning implement, its length to allow a user to reach further, or its curvature to more easily reach around the edge of a toilet bowl. These shapes may also be configured to allow the brush to aesthetically resemble modern toilet brushes despite a radically different internal construction and method of function.

BRIEF DESCRIPTION OF THE DRAWINGS

A more complete understanding of aspects described herein and the advantages thereof may be acquired by referring to the following description in consideration of the accompanying drawings, in which like reference numbers indicate like features, and wherein.

The figures of this disclosure may represent the scale and/or dimensions according to one or more embodiments, and as such contribute to the teaching of such dimensional scaling. However, the disclosure herein is not limited to the scales, dimensions, proportions, and/or orientations shown in the figures.

DETAILED DESCRIPTION

In the following description of the various embodiments, reference is made to the accompanying drawings, which form a part hereof, and in which is shown by way of illustration various embodiments in which aspects described herein may be practiced. It is to be understood that other embodiments may be utilized and structural and functional modifications may be made without departing from the scope of the described aspects and embodiments. Aspects described herein are capable of other embodiments and of being practiced or being carried out in various ways. Also, it is to be understood that the phraseology and terminology used herein are for the purpose of description and should not be regarded as limiting. Rather, the phrases and terms used herein are to be given their broadest interpretation and meaning. The use of "including" and "comprising" and variations thereof is meant to encompass the items listed thereafter and equivalents thereof as well as additional items and equivalents thereof. The use of the terms "mounted," "connected," "coupled," "positioned," "engaged" and similar terms, is meant to include both direct and indirect mounting, connecting, coupling, positioning and engaging.

Figure 1:
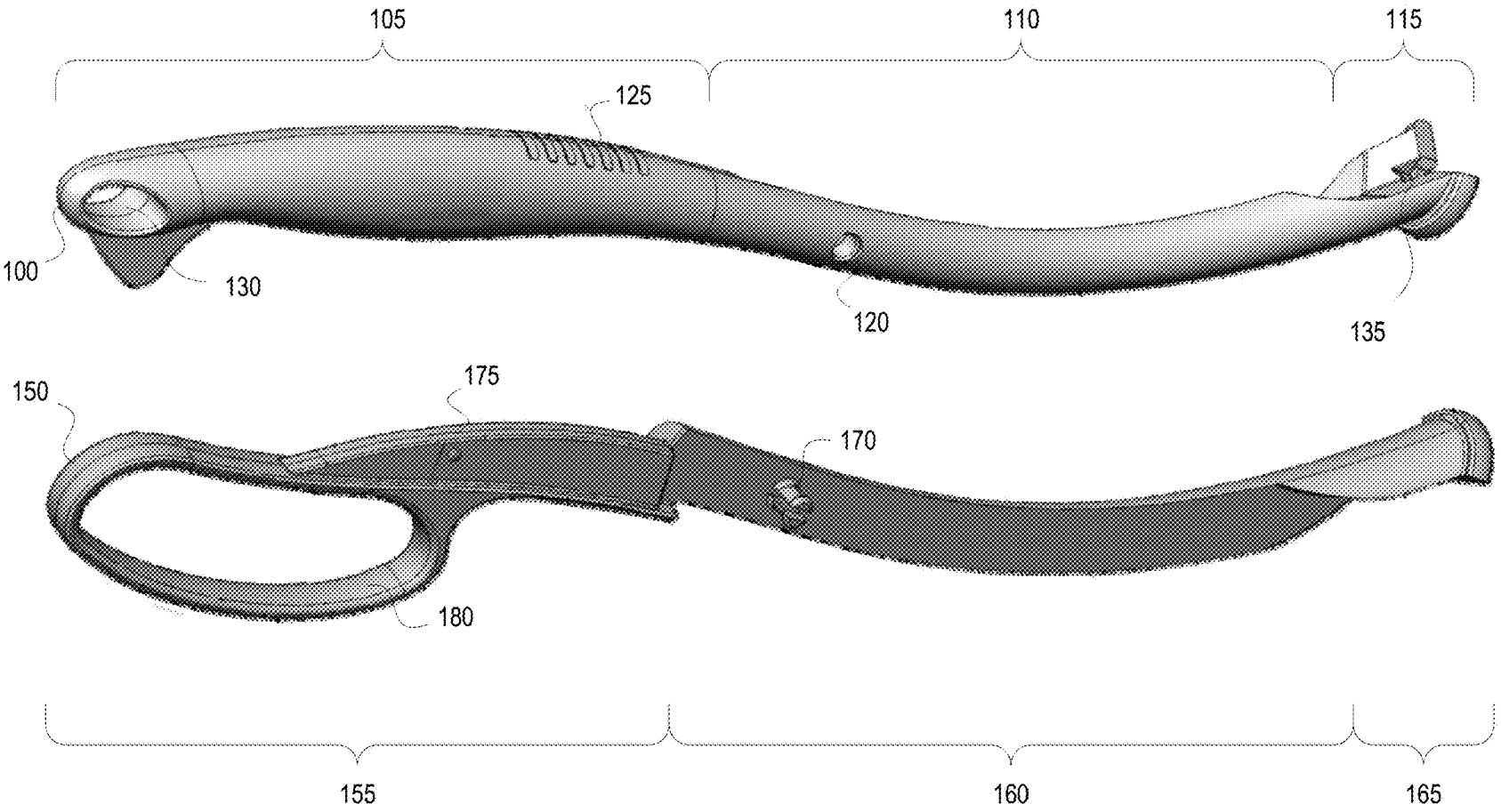
FIG. 1 depicts two elongated members which may be assembled into a toilet brush.

FIG. 1 depicts two elongated members which may be assembled into a toilet brush.

Member 100 is a first member, which may also be referred to herein as the right member. Member 100 may comprise a first handle or upper handle 105, a first shaft 110, and a first jaw or lower jaw 115. Member 150 is a second member, which may also be referred to herein as the left member. Member 150 may comprise a second handle or lower handle 155, a second shaft 160, and a second jaw or upper jaw 165.

Members 100 and 150 may be made from polypropylene, another synthetic plastic polymer such as polycarbonate or polyvinyl chloride, metal, or any other substantially rigid material. The members may be formed by injection molding, 3D-printing, thermoforming, assembly of smaller pre-made sections, carving from a block of material, or any other formation process. Handles 105 and 155 may be completely or partially made from a different material from the rest of members 100 and 150 in order to afford a user a better grip or to make the brush more comfortable to manipulate. In certain examples, a portion or portions of these and/or other sections, or the entire handle and/or handles, are coated with an additional material, such as rubber.

The handles may comprise a pivoting mechanism allowing relative rotation about an axis defined by the pivoting mechanism. For example, first shaft 110 may comprise a cavity 120 which may pass fully through shaft 110. Alternatively, the cavity may only extend partially into the shaft. Second shaft 160 may comprise a pin 170 configured for insertion into cavity 120 and may allow shaft 160 to rotate with respect to shaft 110 while the pin keeps the two shafts affixed together. This rotation may be in a vertical direction perpendicular to a horizontal axis along which the two members 100 and 150 are aligned.

First handle 105 may comprise a series of ridges 125 against which a user may press a thumb to exert more force on the toilet brush or to stabilize the user's grip. In certain examples, one or more other grip features may be present (both with and without the ridges) such as a patterned and/or textured surface, indentations, depressions, apertures, raised bumps, or others. These ridges may be made of the same material as the underlying handle 105, or may be added to the handle and made of a different material such as rubber to increase comfort or to provide more friction and avoid the brush slipping in the user's hand, or another material having a different coefficient of friction compared to the handle material surrounding the ridges. The ridges (or other features) may extend above the surface by 0.01 or more inches, by 0.05 or more inches, or by 0.1 or more inches (or, in examples with e.g. depressions, may go below the surface by these, and other, dimensions). The ridges may be spaced evenly, irregularly, or may form a particular shape configured to fit to a user's thumb.

First handle 105 may comprise a cavity 130, which may pass fully through the handle, forming a ring, or may pass partially through the handle. The cavity or ring may allow the brush to be hung from a peg, hung from a hook, or otherwise kept in a given place by passing an item through the cavity.

Second handle 155 may comprise a flange 175 which may fit into a channel in first handle 105 (not visible from the perspective depicted) and which may stabilize members 100 and 150, and may prevent movement of the members laterally or horizontally with respect to one another and the horizontal axis. In other examples, differently shaped and sized features may be used to prevent such movement. These and other correspondingly shaped, and therefore interlocking features, may also help a user maintain the brush in a closed position by maintaining contact of the handles, so that the brush may tightly grip a cleaning attachment.

Second handle 155 may comprise a ring 180 configured to guide, protect, and/or enclose one or more fingers of the user, when the user uses those fingers to grasp the second handle 155 in conjunction with the user's thumb on first handle 105.

First jaw 115 may comprise a cavity 135 configured to fit together with a corresponding cavity in second jaw 165 (not visible from the perspective depicted) when the brush is in a closed position, in order to surround and grasp the head of a cleaning implement and fix the cleaning implement in place with respect to the first and second members. These cavities may comprise one or more flat surfaces, including bottom flat surfaces, which may prevent relative movement of a correspondingly shaped cleaning attachment.

Figure 2:
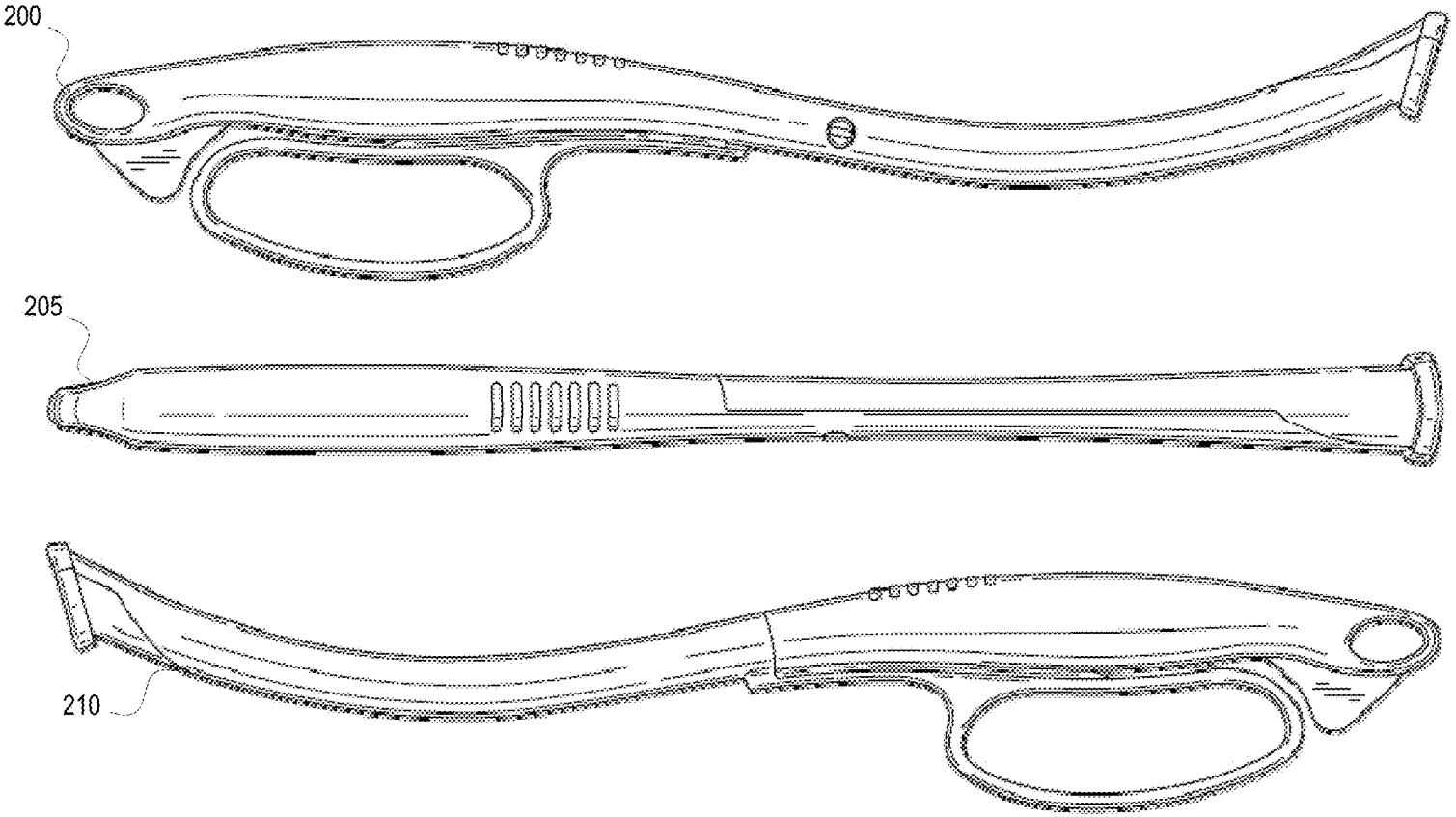
FIG. 2 depicts an assembled toilet brush in a closed position from a first side view, a top view, and from an opposite side view.

FIG. 2 depicts an assembled toilet brush embodying aspects herein in a closed position from a first side view, a top view, and from an opposite side view.

View 200 depicts a right side view of the brush.

View 205 depicts the brush from the top.

View 210 depicts a left side view of the brush.

Figure 3:
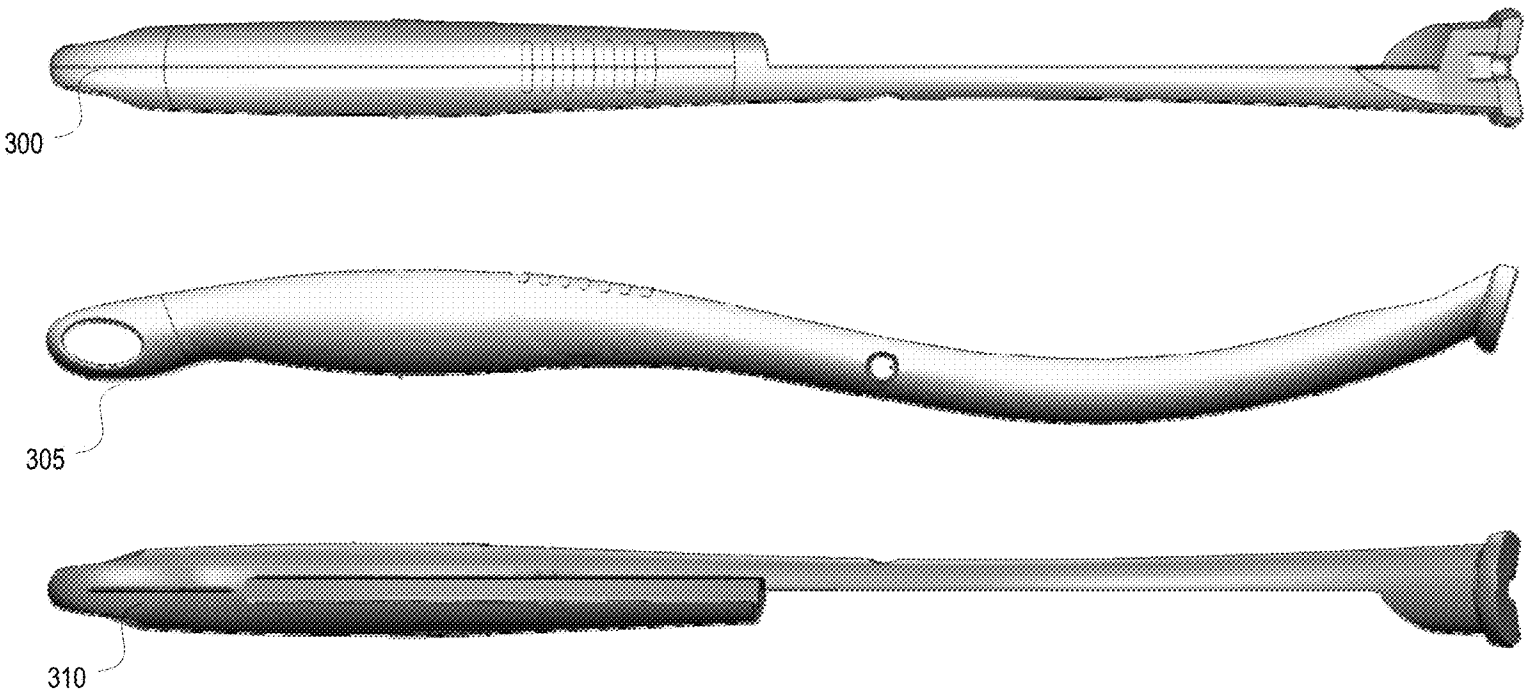
FIG. 3 depicts member 100 from a first side view, a top view, and from an opposite side view.

FIG. 3 depicts a first or right member embodying aspects herein from a first side view, a top view, and from below.

View 300 depicts the right member from the top.

View 305 depicts the right member from the right.

View 310 depicts the right member from below the brush.

Figure 4:
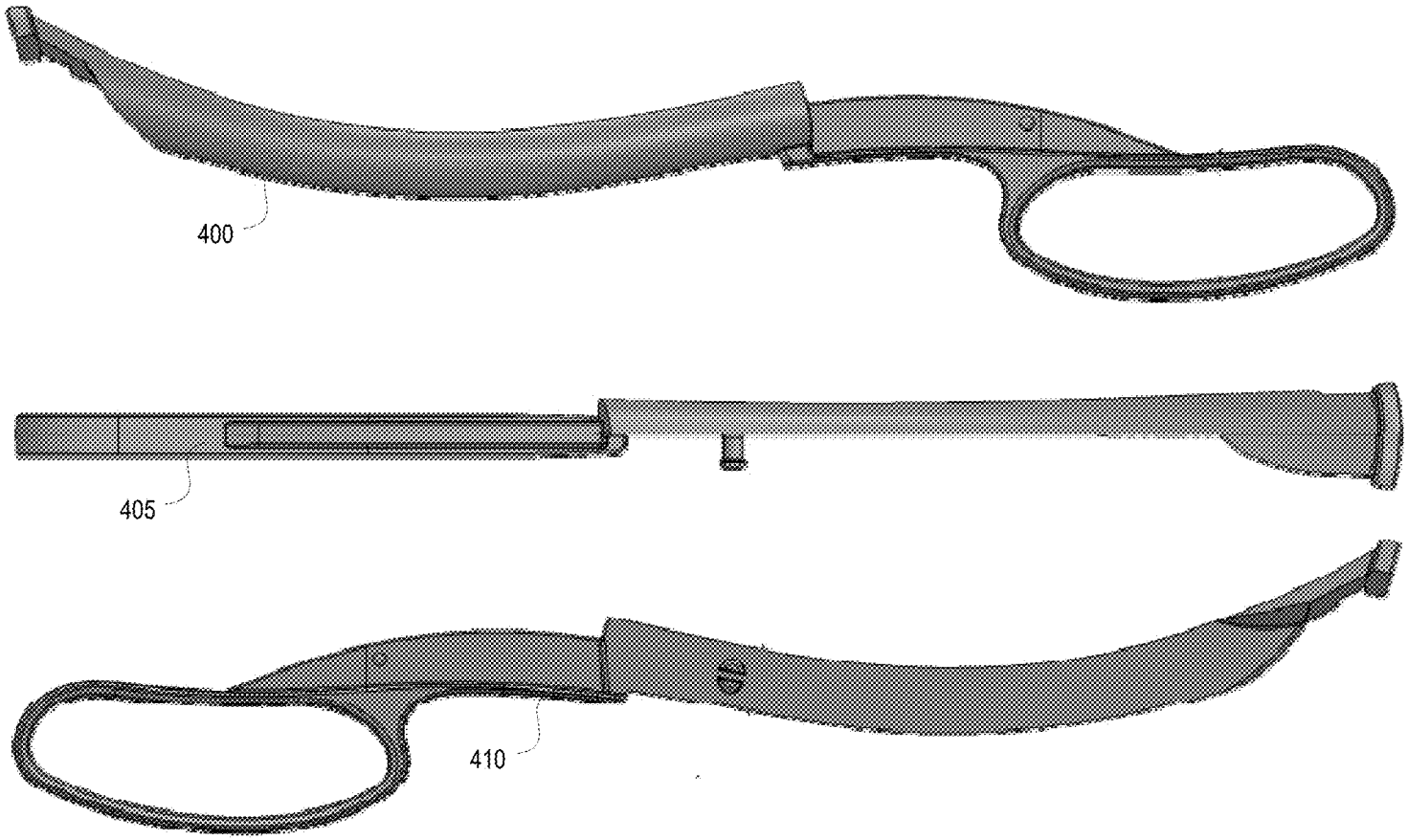
FIG. 4 depicts member 150 from a first side view, a top view, and from an opposite side view.

FIG. 4 depicts member 150 from a first side view, a top view, and from an opposite side view.

View 400 depicts the left member from the left.

View 405 depicts the left member from the top.

View 410 depicts the left member from the right.

Figure 5:
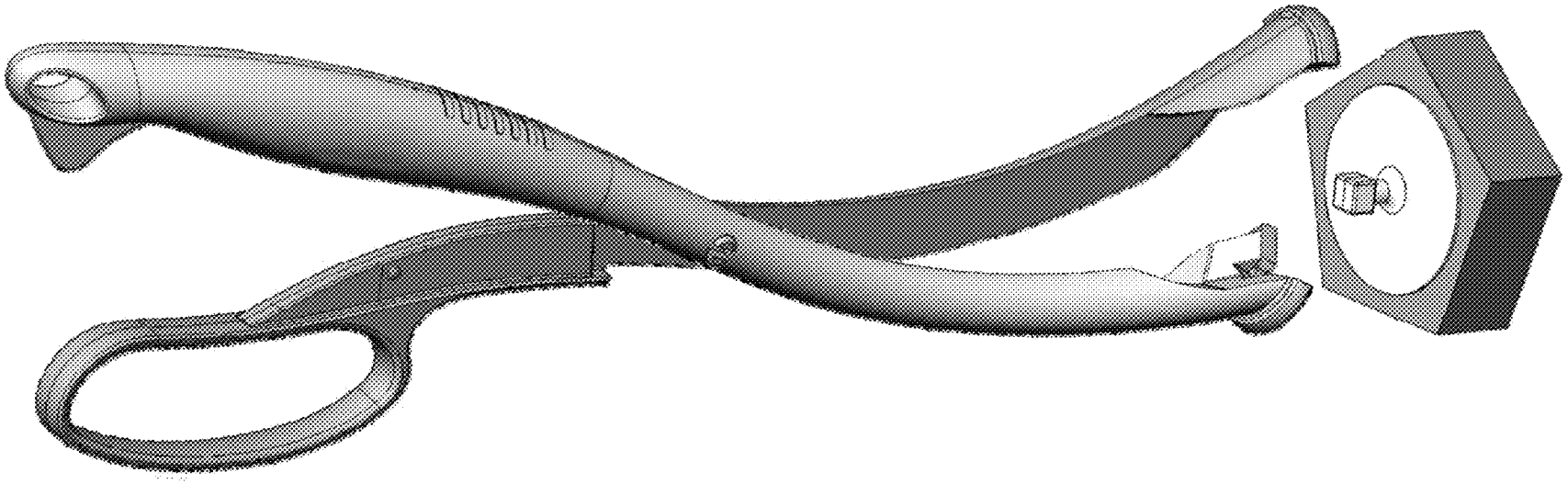
FIG. 5 depicts an assembled toilet brush in an open position, configured for grasping a particular cleaning attachment after the jaws are closed.

FIG. 5 depicts an assembled toilet brush in an open position, configured for grasping a particular cleaning attachment after the jaws are closed.

By squeezing or clenching the hand to bring the two handles together (e.g. after placing a thumb on the first handle, placing one or more fingers within the ring on the second handle) or otherwise bringing the handles together, leverage force may be applied across the pivot point to cause the two jaws to come together, such that the jaw may firmly grasp an item between them. Manipulation of the handles may cause the brush to easily switch between an open position, wherein the two members cross only at the pivot point, and a closed position, wherein the two members are substantially aligned along their lengths. In the open position, the brush may resemble a pair of scissors or pliers in the relative orientation of the members, while in the closed position, the brush may resemble a single cylindrical member, or an essentially cylindrical member with one or more curved (e.g. concave and/or convex) sections. For example, in embodiments with complementary shaped and positions sections (e.g. a shaft on each member that combine to define an essentially circular exterior cross-section) on each member, the brush may resembled an essentially cylindrical member in one or more portions, or along the entire brush. In certain examples, other features may be present about the essentially cylindrical combined member, e.g. the ring 180.

Figure 6A:
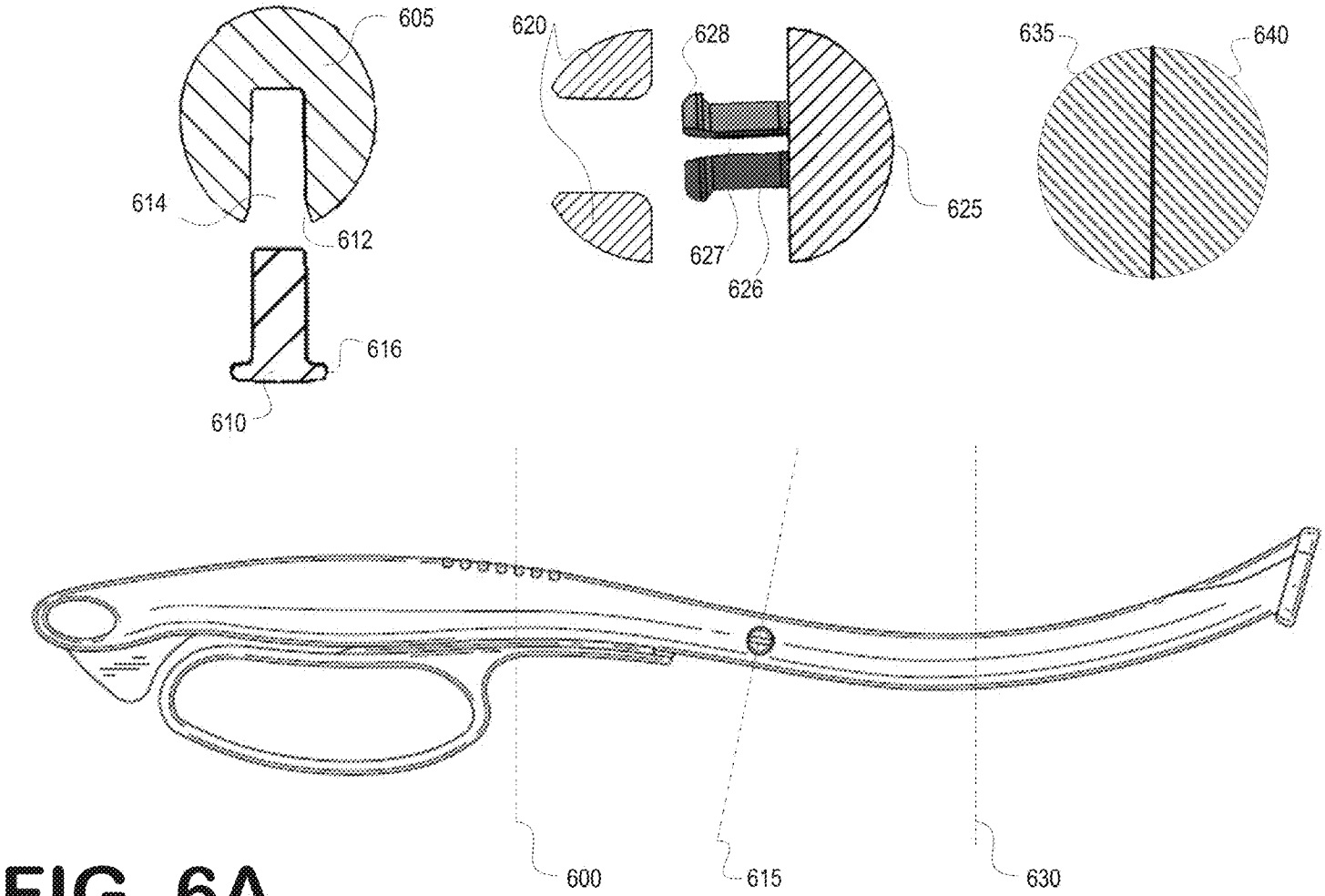
FIGS. 6A and 6B depict cross sections of the two elongated members at various points along their length.
Figure 6B:
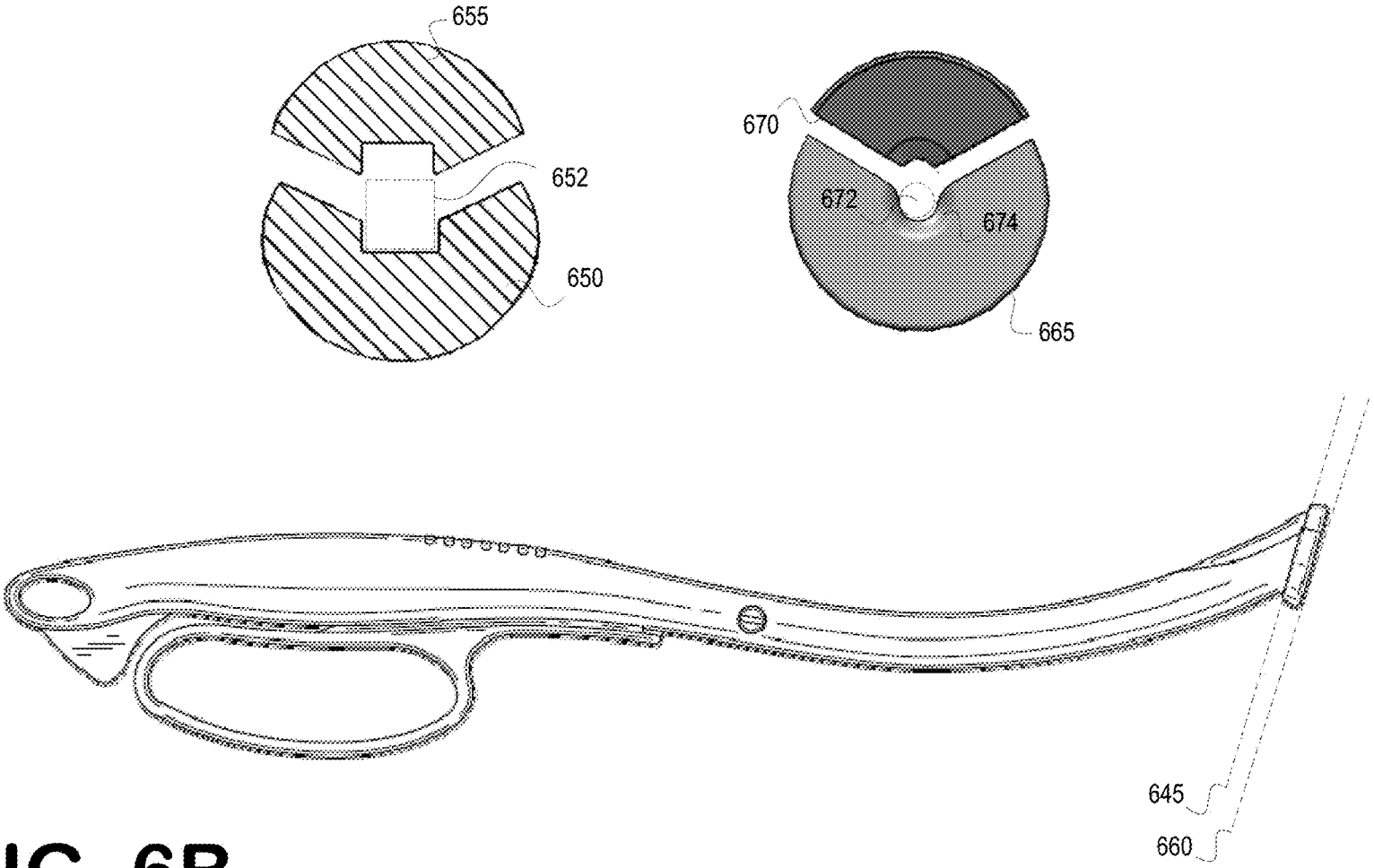

FIGS. 6A and 6B depict a series of cross sections of the two elongated members at various points along their length.

Cross sections 605 and 610 depict a vertical cut through the brush at vertical axis 600. Cross section 610 depicts flange 175 of the second member 150, and cross section 605 depicts a channel 614 in first member 100 configured to accept the flange when the brush is held in a closed position.

The side walls of channel 614 may be substantially vertically aligned, or may be at an angle off of the vertical axes in order to match a shape made by flange 175. The side walls may comprise an opening lip 612 along each side which angles off from the vertical wall. The lips may be configured to guide the flange into the channel when the brush adopts a closed position and the flange and channel are not perfectly aligned. The angle the lip forms with the vertical wall may be 19 degrees, or 18-20 degrees, or 10-30 degrees, or from greater than zero up to fifty degrees. The side walls may extend more than half an inch in depth from the lip to the furthest extent of the channel within the member, and the side walls may comprise one or more concave dimples configured to accept one or more convex dimples on the flange when the brush adopts a closed position, or vice versa, or other corresponding shaped structures, such as a tab and detent structure, or two deformable tabs that allow relative movement past each other upon the application of force by the user.

Flange 175 may comprise substantially vertically aligned side walls, or may have walls angled to form a triangular, trapezoidal, or other narrowing cross section pointing towards the channel. The flange may comprise a wider head 616 which may restrict the flange from entering beyond a maximum depth within the channel when the brush is closed. The head 616 may have a width of 0.5 inches, or 0.45 to 0.55 inches, or 0.25 inches to 1.0 inches. The width of the flange apart from the head and the distance between the side walls of the corresponding channel may be 0.25 inches, or range from 0.2 to 0.4 inches, or range from 0.1 to 0.8 inches.

Cross sections 620 and 625 depict a cut through the brush along plane 615, which passes through the pivot point perpendicular to the shafts. Cross section 620 depicts cavity 120 within the shaft of first member 100, and cross section 625 depicts pin 170 and the shaft of the second member 150. Pin 170 may be inserted into the cavity 120 to form the pivot point.

The pin may be formed of two halves 626 (or other partial segments such as three thirds, four quarter sections, and so on, or unequal sections such as a relatively larger pieces combined with one or more relatively smaller pieces), each with a pin head 628 wider than the rest of the pin half, and with a space 627 removed between the pin halves. If the width of the pin heads and space in their normal position is greater than the diameter of cavity 120, the two pin halves may nonetheless be squeezed together, narrowing space 627, and allowing the two pin heads to be forced through to the other side of cavity 120. Once through, the pin heads may be able to adopt their normal position and space 627 expanded, fixing the members 100 and 150 together unless the pin is squeezed and removed from the cavity. In certain examples, a single structure forms the pin, and comprises one or more slits, cavities, or other points of weakness allowing passage through the cavity. In other examples, the cavity comprises one or more deformable or moveable features, and the pin is substantially rigid and/or non-deformable.

The total diameter of cavity 120 or of pin 170 may be 0.3 inches, or 0.25 to 0.35 inches, or 0.1 to 0.5 inches. The pin heads may have a height of 0.07 inches, or 0.06 to 0.1 inches, or 0.04 to 0.2 inches. The height of the remainder of the pin, between the head and the second shaft, may be 0.32 inches, or 0.3 to 0.35 inches, or 0.1 to 0.5 inches. The space 627, before any deformation of the pin to fit into the cavity, may have a width of 0.08inches, or 0.06 to 0.1 inches, or 0.04 to 0.15 inches.

Cross sections 635 and 640 depict a vertical cut through the brush along vertical plane 630. Along the first and second shaft from the pivot point to the jaws, cross sections of the first shaft 635 and of the second shaft 640 may be shaped so that, when the brush is held in a closed position, the cross sections of the two shafts form an essentially circular cross section. This may be accomplished by cross sections which are each semicircular in shape and have diameters aligned along the vertical plane for the length of the shafts; semicircular in shape with diameters aligned along the horizontal plane for the length of the shafts; or semicircular in shape with a rotation in the axis of the diameters along the length of the shafts, forming a partial double helix shape with up to a 180 degree rotation along the length of each helix, such that the flat and/or interacting faces rotate in orientation along the length of the shaft. Alternatively, the cross sections may be two congruent shapes other than semicircles, rotated 180 degrees with respect to each other, such as two paisley shapes which form a "yin yang"-like shape. Alternatively, the cross sections may be incongruent regions which nonetheless come together to form a circular shape, such as a 270 degree sector of a circle and a 90 degree sector of a circle; a 240 degree sector of a circle and a 120 degree sector of a circle; or any other two sectors summing to 360 degrees or to an angle of less than 360 degrees. Alternatively, the cross sections may be configured to come together to form a shape other than a circle, such as an ellipse, a triangle, a square, another polygon, or any desired convex or concave shape.

Cross sections 650 and 655 depict a cut through the brush along plane 645, which runs parallel to the tips of the jaws and very close to the tips. Like cross sections 635 and 640, cross section 650 from the right member and cross section 655 from the left member may be configured to form a circular cross section when aligned due to the brush being in a closed position. Thus, cross sections 650 and 655 may be semicircular in shape and have diameters aligned essentially vertically; semicircular in shape with diameters aligned essentially horizontally; or two incongruent regions which nonetheless come together to form a circular shape, such as two sectors of a circle. Cross section 650 may be a sector with a larger angle of the two sectors, such as one of 231 degrees, or 220 to 260 degrees, or 181 to 300 degrees. Cross section 655 may be a smaller sector of the two sectors, such as one of 129 degrees, or 100 to 140 degrees, or 60 to 179 degrees.

Cross sections 650 and 655 may have material absent from their sectors such that a cavity with shaped cross section 652 is formed between them when the brush is closed. The cavity may comprise one or more flat surfaces to prevent relative movement of a cleaning attachment grasping therein, as described in more detail below. Shaped cross section 652 may have a square cross section, or a cross section which is an ellipse, a triangle, another polygon, or any desired convex or concave shape. The cavity may be shaped to snugly fit a head of a cleaning attachment, which may be inserted into the brush while the brush is in an open position and grasped between the jaws of the brush when the brush is in a closed position. In order to prevent rotation of the cleaning attachment within the cavity when the brush is closed, shaped cross section 652 may be configured to not be a circular cross section, and/or not comprise any curved surfaces. In certain examples, the cavity is essentially square, and comprises flat surfaces along the sides, bottom, and top. These examples, when used to grasp a corresponding shaped cleaning attachment also comprising flat surfaces, prevent any relative movement of the cleaning attachment, such as rotation, and further prevent, via the bottom flat surfaces, the cleaning attachment from coming out of the cavity when the brush is in the closed position, even when forces are acting on the cleaning attachment when being used by the user. Further, in examples with side flat surfaces, these side surfaces prevent any pivoting or shifting of the cleaning attachment within the cavity, even when forces are acting on the cleaning attachment when being used by the user. In certain examples, one or more flat surfaces of the cavity are parallel to the axis of rotation of the members to each other.

Thus, in some examples, the cleaning attachment will then may fall away automatically when the brush is opened, as any retaining surfaces of the cavity (or at least some retaining surfaces) are no longer adjacent to or surround the cleaning attachment head, and therefore does not require any user contact with the cleaning attachment during disposal. Thus, examples of the brush may allow a user to easily grasp a cleaning attachment in a brush that tightly hold the attachment during use (and can prevent relative movement thereof) while allowing a use to dispose of the attachment without contact, and without the need to additional mechanical parts (e.g. a push-button based-mechanism) that may be subject to failure, increase complexity and costs of manufacture, increase complexity for a user, or suffer from other deficiencies.

Surfaces 665 and 670 depict a view of the tips of the jaws along plane 660, which runs parallel to and along the surface of the tips of the jaws. The tips of the first jaw 115 and second jaw 165 may be configured to come together to form an essentially circular shape. Surfaces 665 and 670 may be shaped as sectors of circles, and may be sectors with angles the same or similar to the angles of sectors in cross sections 650 and 655. Surface 665, at the tip of first jaw 115, may be a larger sector, such as one of 240 degrees, or 220 to 260 degrees, or 181 to 300 degrees. Surface 670, at the tip of second jaw 165, may be a smaller sector, such as one of 120 degrees, or 100 to 140 degrees, or 60 to 179 degrees. In certain examples, these surfaces may essentially be continuations of and identical to the adjacent portions of the jaws (e.g. cross-sections 650 and 655), rather than additional or distinct pieces or surfaces.

Surfaces 665 and 670, when in contact, may comprise an aperture or opening with an area 672, which may be a smaller than shaped cross section 652 to prevent the head grasped within the cavity from passing through area 672 (e.g. since this allows for one or more bottom, flat surfaces of the cavity) and thus prevent the cleaning attachment from falling away from or out of the brush when the brush is in a closed position. The cavity may comprise a flat bottom surface flush with the aperture, against which a corresponding flat bottom surface of a head of the cleaning attachment may rest, preventing the cleaning attachment from passing through the aperture.

In some examples, the area 672 may be recessed from the surfaces, and the surfaces may curve down in a bowl or cone shape 674 to meet the edge of area 672. The curvature of shape 674 may have a radius of between 0.10 and 0.11 inches, 0.08 and 0.13 inches, or 0.06 and 0.2 inches, and this radius may correspond to the depth by which area 672 is recessed from the surfaces, so that the surface of the bowl may be perpendicular to surfaces 665 and 670 at the boundary of area 672.

Figure 7:
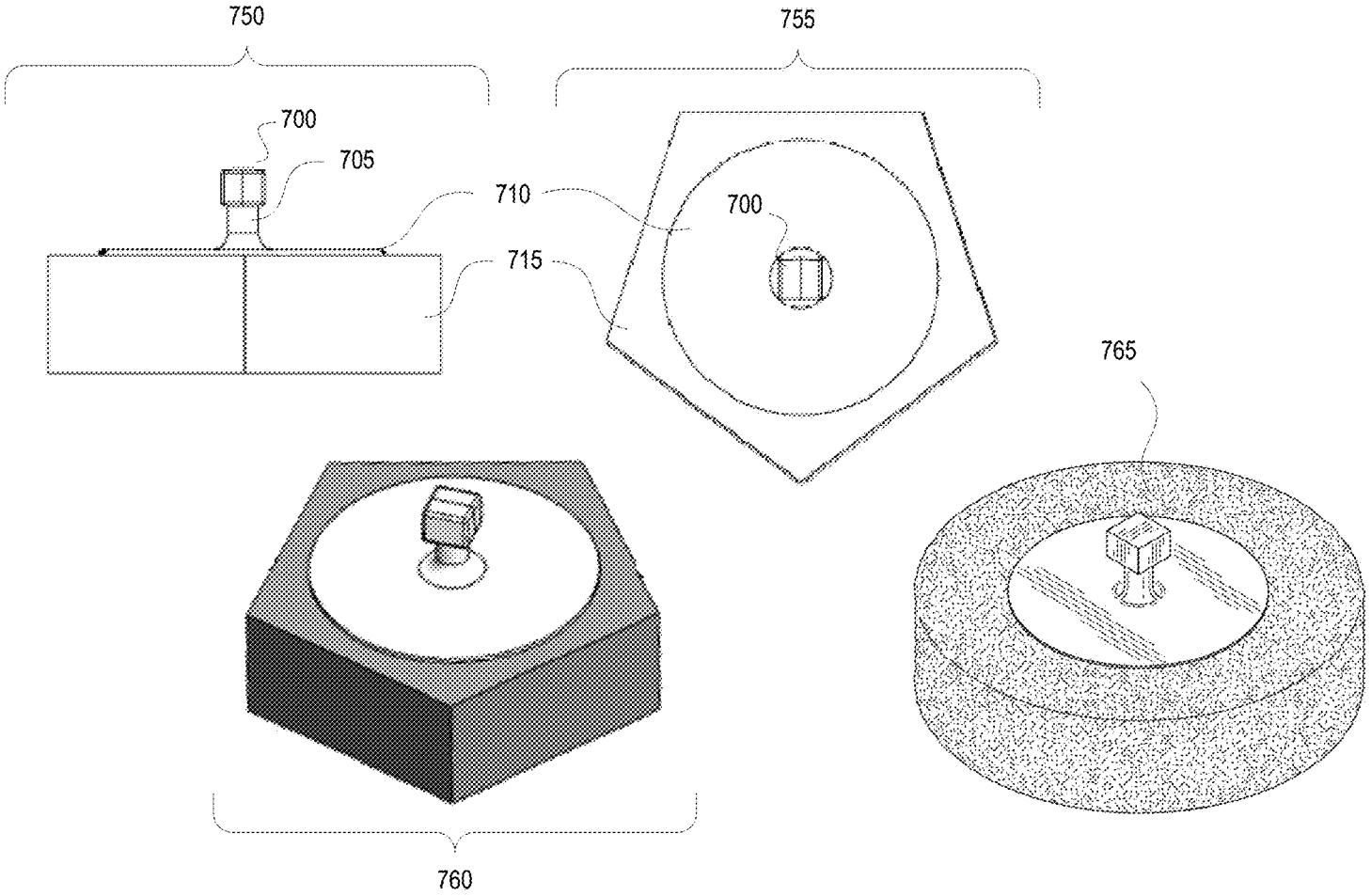
FIG. 7 depicts a possible cleaning attachment for which the jaws may be configured.

FIG. 7 depicts a possible cleaning attachment for which the jaws may be configured.

View 750 displays a cleaning attachment from a side view, view 755 displays the cleaning attachment from a top view, and view 760 displays the cleaning attachment from an angle between side and top.

Image 765 depicts a cleaning attachment according to one or more aspects described herein, illustrating a circular cleaning attachment.

The cleaning attachment may comprise a head 700, a neck 705, an adhesion surface 710, and a cleaning pad 715.

Head 700 may be formed of polypropylene, another synthetic plastic polymer such as polycarbonate or polyvinyl chloride, the same material as either the first or second member, or any other substantially rigid material. The head may have an essentially square cross section, or may have a cross section of another polygonal shape, a polygonal shape with rounded corners, or any other convex or concave shape. The side length of the head cross section may be 0.28 inches, or 0.26 to 0.3 inches, or 0.15 to 0.5 inches. The side surfaces of the head may be rectangular, square, or any other flat or curved surface which corresponds to the cross section shape of the head to form a rectangular prism, other polygonal prism, polyhedron with rounded corners, or other three-dimensional shape. In some examples, the head may be other shapes, for example, curved, ellipsoidal, and/or circular or cylindrical. The height of the side surfaces may be 0.23 inches, or 0.2 to 0.25 inches, or 0.1 to 0.4 inches. The head may comprise a flat bottom surface, which may rest against the bottom surface(s) defining the cavity between the jaws when the jaws are in the closed position. One or more of the side surfaces of the head may rest against one or more side surfaces of the cavity, preventing the head from rotating, pivoting, and/or otherwise moving around within the cavity and/or relative to the cavity when the jaws are in the closed position. In some examples, the side surfaces of the head are flat (e.g. in a square shaped head) to prevent relative rotation. In certain examples, the head comprises a plurality of flat surfaces to prevent relative rotation, movement, and/or pivoting of the head within the cavity and/or relative to the jaws and brush handle.

Neck 705 may connect head 700 to adhesion surface 710. The neck may be formed of polypropylene, another synthetic plastic polymer such as polycarbonate or polyvinyl chloride, the same material as either the first or second member, the same material as the head, or any other substantially rigid material, such that a user may apply force in cleaning without undesirable deformation of the device or portions thereof. In some examples, the neck is rigid and/or non-bendable due to its material characteristics and/or other features (for example, examples where a large portion of the neck is clasped between the jaws), or substantially has these characteristics. The neck may be narrower than the head, so that the neck may pass through the aperture with area 672 when the jaws of the brush are in the closed position, while the head may not pass through. The neck may have a cross section which is circular, square, triangular, or any other polygonal or curved shape, and may correspond to area 672 to fill the area. The neck may have a diameter or width of 0.19 inches, or 0.16 to 0.22 inches, or 0.1 to 0.3 inches, and may extend a length between the head and adhesion surface of 0.28 inches, or 0.25 to 0.32 inches, or 0.1 to 0.5 inches. The neck may extend straight down from the head to the adhesion surface 710, or may flare out in a curved, trumpet-like shape as it approaches the adhesion surface. The radius of any such curvature may be 0.1 inches, or 0.05 to 0.15 inches, or 0.02 to 0.2 inches. In some examples, the neck is rectangular or otherwise includes one or more flat surfaces, to further inhibit relative motion, rotation, and/or pivoting. In some examples, the head and/or neck comprise other features for interlocking with the brush, such as a tab or detent shaped and sized to interact with a corresponding feature on a jaw or jaws. In some examples, the jaws include one or more flat surfaces, prongs, or projections that come in contact with the neck. In various examples, the jaws nearly reach adhesion surface 710 when the jaws are closed. In some examples, the outermost surfaces of the closed jaws are 0.05 inches or less from the adhesion surface, in others 0.03 or less, and in still others 0.01 or less.

Adhesion surface 710 may be formed of polypropylene, another synthetic plastic polymer such as polycarbonate or polyvinyl chloride, the same material as either the first or second member, the same material as either the head or neck, or any other substantially rigid material. In some examples, the surface is made from a material and/or has an appropriate thickness such that it is rigid, non-flexible, and/or non-bendable, or substantially has one or more of these characteristics. The adhesion surface may have a circular cross section, or a cross section of any polygonal or other shape, and the surface may be configured to have the same area as cleaning pad 715, a lesser area, or a greater area. The adhesion surface may have a thickness of 0.04 inches, or 0.03 to 0.06 inches, or 0.01 to 0.1 inches. The adhesion surface may be affixed to cleaning pad 715, and may be affixed to or molded together with neck 705.

The adhesion surface may adhere to cleaning pad 715 via a waterproof adhesive which will not degrade after being submerged in or exposed to water. The adhesion surface may further comprise a number of teeth, dimples, or other rough surfaces configured to press into or penetrate the cleaning pad and stabilize the pad with respect to the adhesion surface during cleaning. The teeth may have a length of 0.08 inches, or 0.06 to 0.1 inches, or 0.02 to 0.2 inches. The teeth may be essentially pyramidal or triangular in shape.

Cleaning pad 715 may have a circular cross section, pentagonal cross section, or any other polygonal or curved shape. The cleaning pad may be formed from a non-woven synthetic or any other waterproof material with a high coefficient of friction suitable for use as a scrubbing pad. The cleaning pad may be relatively dense non-woven material. The cleaning pad may have a uniform consistency throughout, such as a sponge, foam, or solid consistency, or may have an additional abrasive texturing of the material along the outside of the pad. The cleaning pad may have a thickness of 0.75 inches, or 0.7 to 0.8 inches, or 0.5 to 1.5 inches. The diameter, or width, or longest dimension of the pad (as appropriate for describing a given shape of pad) may be 3 inches, or 2.5 to 3.5 inches, or 1.5 to 5 inches. The cleaning pad may include or be imbibed with one or more cleaner solutions or products, and/or one or more surfactants, and/or other components such as dyes or fragrances. In some examples, a form of sodium hypochlorite is added.

In one embodiment, there may be a cleaning implement comprising a first elongated member comprising a first handle, a first jaw, and a first shaft connecting the first handle and the first jaw; and a second elongated member comprising a second handle, a second jaw, and a second shaft connecting the second handle and the second jaw, wherein the second elongated member is configured to be affixed to the first elongated member at a pivot point such that the second elongated member may rotate about the pivot point, relative to the first elongated member, from a closed position, where the elongated members are essentially aligned with each other and where the first jaw and the second jaw are in contact with each other, to an open position, where the first jaw and the second jaw are not in contact with each other; and wherein the first jaw and second jaw are configured to, when in the closed position, grasp a cleaning attachment between them in a fixed position.

The cleaning implement may be configured such that the cleaning attachment may not rotate relative to the elongated members when in the fixed position. The cleaning implement may be configured such that the cleaning attachment may not pivot, shift or move relative to the elongated members when in the fixed position. The cleaning implement may be configured such that the cleaning attachment remains in essentially the same orientation and position relative to the elongated members when in use.

The cleaning attachment may comprise a head having a non-circular cross section, and the head may have a cross section which is polygonal.

The head may have a square cross section comprising one or more flat, outer surfaces, wherein the first and second jaw collectively have one or more flat, inner surfaces defining a cavity shaped and sized to receive the head, and wherein the inner and outer flat surfaces prevent relative rotation of the head and the jaws when the head is in the fixed position.

The first shaft and the second shaft may comprise corresponding shaped interior surfaces such that they are configured to, when the second elongated member is in the closed position, collectively provide an essentially circular exterior shape of the adjacent shaft sections.

The first shaft and the second shaft may each comprise an essentially semicircular cross section.

The first handle may comprise a channel configured to receive a flange of the second handle when the second elongated member is in the closed position.

The second handle may comprise a projection connected to the flange. The projection may form a loop defining an interior cavity.

The first shaft may further comprise a cavity at the pivot point, and the second shaft may have a correspondingly shaped pin at the pivot point configured for insertion in the cavity. The pin may be temporarily deformable such that after insertion in the cavity, the pin resists extraction from the cavity.

The first and second elongated members, when aligned in the closed position, may generally define a horizontal axis, and the second elongated member may rotate about the pivot such that the second elongated member may move through a vertical plane perpendicular to the horizontal axis.

The first handle may comprise a channel configured to receive a flange of the second handle when the second elongated member is in the closed position, and the channel may be in the vertical plane.

The first and second elongated members, when aligned in the closed position, may generally define a concave and a convex section relative to the horizontal axis. The pivot point may be at an intersection of the concave and convex sections.

The first jaw may terminate in an end surface comprising a cross section of a circular sector with a central angle of more than 180 degrees, and the second jaw may terminate in an end surface comprising a corresponding cross section of a circular sector with a central angle of less than 180 degrees, and the first and second jaw may define a cavity when the second elongated member is in the closed position.

The first jaw and second jaw may be configured to form a cavity between them when in the closed position, and the cavity may comprise one or more flat bottom surfaces. In some examples, the one or more flat bottom surfaces define an aperture narrower than a corresponding flat bottom surface of a head of the cleaning attachment. In some examples, the bottom surface or surfaces of the cavity can then prevent the head of the cleaning attachment from exiting the cavity, for example through an aperture. The cavity may comprise one or more side surfaces (e.g. flat side surfaces) with which one of more side surfaces of a head of the cleaning attachment come into contact, preventing the cleaning attachment from rotating around a central axis of the cavity, and/or pivoting relative to the central axis of the cavity. The one or more flat surfaces may act to collectively prevent the head, and therefor the cleaning attachment as a whole, from moving or shifting relative to the cavity when the first and second jaw are closed, facilitating a the use of the cleaning device even during vigorous application, scrubbing, and the like.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A cleaning implement comprising:

A cleaning attachment comprising a head with a non-circular cross section connected to a first side of a substantially planar support, and further comprising a cleaning pad secured to a second opposite side of the substantially planar support;

a first elongated member comprising a first handle, a first jaw, and a first shaft connecting the first handle and the first jaw; and a second elongated member comprising a second handle, a second jaw, and a second shaft connecting the second handle and the second jaw, wherein the second elongated member is configured to be affixed to the first elongated member at a pivot point such that the second elongated member may rotate about the pivot point, relative to the first elongated member, from a closed position, where the elongated members are essentially aligned with each other and where the first jaw and the second jaw are in contact with each other, to an open position, where the first jaw and the second jaw are not in contact with each other; and wherein the first jaw and second jaw are configured to, when in the closed position, define a cavity shaped and sized to receive the head of the cleaning attachment and grasp the head of the cleaning attachment between them in a fixed position; and wherein the head has one or more flat, outer surfaces, and wherein the first and second jaw collectively have one or more flat, inner surfaces defining at least part of the cavity, and wherein the inner and outer flat surfaces are adjacent to each other when the head is in the fixed position such that the flat surfaces prevent relative movement between the head and the jaws.

2. The implement of claim 1, wherein the cleaning attachment may not rotate relative to the elongated members when in the fixed position.

3. The implement of claim 1, wherein the head has a cross section which is polygonal.

4. The implement of claim 1, wherein the head has a square cross section.

5. The implement of claim 1, wherein the first shaft and the second shaft comprise corresponding shaped interior surfaces such that they are configured to, when the second elongated member is in the closed position, collectively provide an essentially circular exterior shape of the adjacent shafts.

6. The implement of claim 5, wherein the first shaft and the second shaft each comprise an essentially semicircular cross section.

7. The implement of claim 1, wherein the first handle comprises a channel configured to receive a flange of the second handle when the second elongated member is in the closed position.

8. The implement of claim 7, wherein the second handle comprises a projection connected to the flange.

9. The implement of claim 8, wherein the projection forms a loop defining an interior cavity.

10. The implement of claim 1, wherein the first shaft further comprises a pivot cavity at the pivot point, and the second shaft has a correspondingly shaped pin at the pivot point configured for insertion in the pivot cavity.

11. The implement of claim 10, wherein the pin is temporarily deformable such that after insertion in the pivot cavity, the pin resists extraction from the cavity.

12. The implement of claim 1, wherein the first and second elongated members, when aligned in the closed position, generally define a horizontal axis, and the second elongated member may rotate about the pivot point such that the second elongated member may move through a vertical plane perpendicular to the horizontal axis.

13. The implement of claim 12, wherein the first handle comprises a channel configured to receive a flange of the second handle when the second elongated member is in the closed position, and wherein the channel is in the vertical plane.

14. The implement of claim 12, wherein the first and second elongated members, when aligned in the closed position, generally define a concave and a convex section relative to the horizontal axis.

15. The implement of claim 14, wherein the pivot point is at an intersection of the concave and convex sections.

16. The implement of claim 1, wherein the first jaw terminates in an end surface comprising a cross section of a circular sector with a central angle of more than 180degrees, and wherein the second jaw terminates in an end surface comprising a corresponding cross section of a circular sector with a central angle of less than 180 degrees.

17. The implement of claim 1, wherein the cavity comprises at least one flat bottom surface configured to come into contact with at least one corresponding flat bottom surface of the head of the cleaning attachment when the first jaw and second jaw are in the closed position, preventing the head of the cleaning attachment from exiting the cavity.

18. The implement of claim 17, wherein the cavity further comprises one or more side surfaces with which one of more side surfaces of the head of the cleaning attachment come into contact, further preventing the cleaning attachment from rotating around a central axis of the cavity, or pivoting relative to the central axis of the cavity.

19. The implement of claim 1, wherein the cavity comprises one or more side surfaces with which one of more side surfaces of the head of the cleaning attachment come into contact, preventing the cleaning attachment from rotating around a central axis of the cavity, or pivoting relative to the central axis of the cavity.

* * * * *